US006000578A

United States Patent [19]

Boissay

[11] Patent Number: 6,000,578

[45] **Date of Patent: *Dec. 14, 1999**

[54] BOTTLE BODY AND PRODUCT DISPENSING BOTTLE

[75] Inventor: Michel Pierre Boissay, Offranville, France

[73] Assignee: Carnaudmetalbox Sante-Beaute, Saint Ouen, France

[ * ] Notice: This patent is subject to a terminal disclaimer.

[21] Appl. No.: 08/875,588

[22] PCT Filed: Mar. 2, 1995

[86] PCT No.: PCT/FR95/00252

§ 371 Date: Oct. 15, 1997

§ 102(e) Date: Oct. 15, 1997

[87] PCT Pub. No.: WO96/23706

PCT Pub. Date: Aug. 8, 1996

[30] Foreign Application Priority Data

Feb. 1, 1995 [FR] France ..... 95 01175

[51] Int. Cl.[6] ..... B67D 5/00

[52] U.S. Cl. ..... 222/83; 222/81; 222/83.5; 222/153.06; 222/153.07; 222/541.2; 222/541.4

[58] Field of Search ..... 222/83, 81, 83.5, 222/88, 153.06, 153.07, 541.2, 541.4; 141/113, 327, 326, 329, 364; 53/242

[56] References Cited

U.S. PATENT DOCUMENTS

| | | | |
|---|---|---|---|
| 3,029,987 | 4/1962 | Gronemeyer | 222/541 |
| 5,042,690 | 8/1991 | O'Meara | 222/83 |

FOREIGN PATENT DOCUMENTS

| | | |
|---|---|---|
| 0293290 | 11/1988 | European Pat. Off. . |
| 0304972 | 3/1989 | European Pat. Off. . |
| 590293 | 4/1994 | European Pat. Off. . |
| 2236748 | 1/1975 | France . |
| 2285311 | 4/1976 | France . |
| 2622795 | 5/1989 | France . |

*Primary Examiner*—David J. Walczak
*Assistant Examiner*—Timothy L. Maust
*Attorney, Agent, or Firm*—Wenderoth, Lind & Ponack, L.L.P.

[57] ABSTRACT

A bottle body formed of plastic injection-molded in a single piece. The bottle body includes a hollow body (12) with an open rear end (18) for filling the body with a fluid product, and a narrowed front end forming a neck (20). The body includes a transverse tear-off seal (22) integrally formed with the body for sealing the corresponding end of the body (12). The body is suitable for bottles for ophthalmological products.

12 Claims, 3 Drawing Sheets

BOTTLE BODY AND PRODUCT DISPENSING BOTTLE

BACKGROUND OF THE INVENTION

The present invention relates to a bottle body and to a bottle which are intended to contain a fluid product, and to a method for manufacturing such a bottle.

Bottle bodies, formed of a single piece of injected plastic, of the type which have an open rear end to allow them to be filled with a fluid product, and a narrowed front end forming a neck, are known in the prior art.

Prior to the filling operation, the neck is generally sealed by an attached membrane which is intended to be pierced when the bottle is put into actual use.

Some of these bottles are intended to contain a sterile product, for example an eye ointment.

When the neck is being sealed using the membrane, foreign bodies can enter the body of the bottle and can thus contaminate that the product that the body is intended to contain.

SUMMARY OF THE INVENTION

The purpose of the invention is to provide a bottle which is intended to be filled with a fluid product, and making it possible to limit, as much as possible, the number of operations needed for filling the bottle so as to limit the risk of contamination.

The subject of the invention is therefore a bottle body of the aforementioned type, characterized in that it comprises a tearable transverse membranae formed integrally with the body and sealing the front end region of the body.

The bottle according to the invention may have one or more of the following features:

- the membrane has a thinned region with less mechanical strength so that the membrane can be torn;
- the thinned region constitutes a star which weakens the membrane, especially a four-pointed star;
- the bottle further comprises means of piercing the membrane, which means can be moved axially in the neck between a standby position and an active position for piercing the membrane under the command of a manipulating member connected to the rest of the bottle by frangible means for tamperproofing and for keeping the piercing means in the standby position;
- the manipulating member is formed of a cap which goes over the neck and can be moved axially with respect thereto after the tamperproofing means have been removed, the cap has a surface for resting against a surface disposed opposite thereto and belonging to the piercing means, and the piercing means are formed of an end piece mounted on the free end of the neck and through which a duct passes longitudinally for the flow of a fluid product, the end piece comprising a stem for tearing the membrane and extending into the neck;
- the tamperproofing means have a lip on the inside, which interacts with a collar formed on an exterior surface of the bottle, and the cap has a similar lip on its inside;
- the body and the end piece comprise means for positioning them in at least two relative axial positions;
- the end piece comprises an axial skirt surrounding the neck, the means of positioning the end piece comprising successive means of snap-fastening between at least one collar and at least one catch which are situated on the external face of the neck and on the internal face of the skirt.

The invention also relates to a pre-assembled bottle, comprising a bottle body made of injected plastic. The bottle body has an open rear end, a narrowed front end and a neck sealed by a tearable transverse membrane. Also provided is an end piece which can be moved axially in the neck between a standby position and an active position for piercing the membrane and through which a duct passes longitudinally for a fluid product to flow along. Also, a cap is provided which goes over the neck and has tamperproofing means keeping the end piece in the standby position.

Another subject of the invention is a method of producing a bottle, characterized in that the method comprises:

- producing, by injecting a plastic, a body which has an open end, an opposite end forming a neck, an end piece through which a duct passes longitudinally for fluid product to flow along, and a cap;
- with the body sealed by a tearable membrane, assembling the end piece on the neck in such a way that the end piece can be moved axially in the neck between a standby position and an active position for piercing the membrane, and covering the neck using the cap which is connected to the body of the bottle by frangible means for tamperproofing and maintaining the end piece in the standby position;
- filling the body with a fluid product via its open end; and
- sealing the open end of the body by pinching the open end together and welding it.

BRIEF DESCRIPTION OF THE DRAWINGS

Other features and advantages of the invention will become clear from the following description given by way of a non-limiting example with reference to the attached drawings in which.

DETAILED DESCRIPTION OF THE INVENTION

Figure 1:
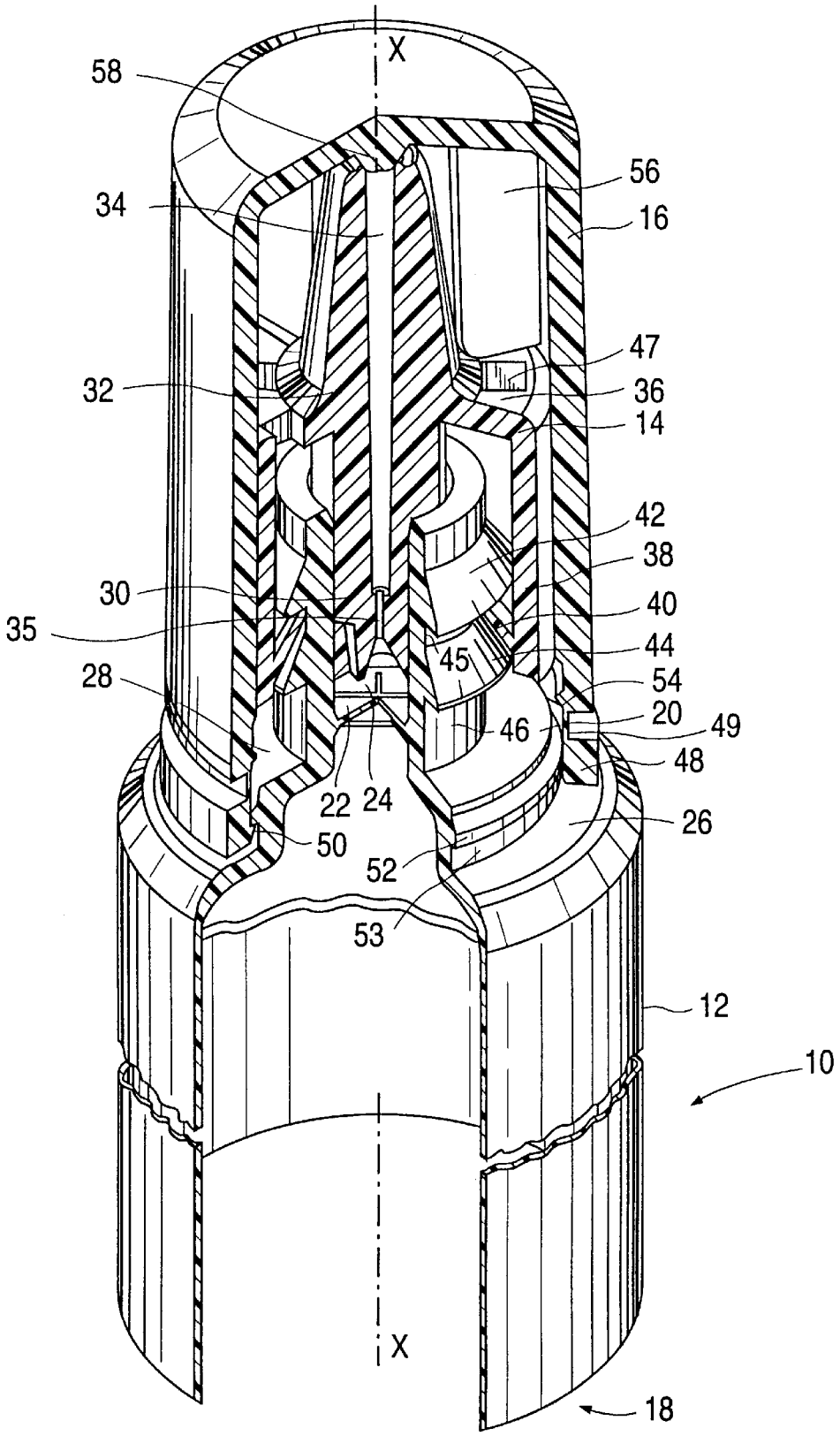
FIG. 1 depicts a perspective view in partial section of a pre-assembled bottle constructed in accordance with the present invention.

FIG. 1 shows a pre-assembled bottle 10 comprising a hollow body 12 intended to receive a sterile fluid product. The hollow body 12 has an end piece 14 and a cap 16. The unit as a whole has an overall axis of symmetry X—X which is assumed to be vertical.

The hollow body 12 has an open lower and rear end 18 to allow it to be filled, and a narrowed upper and front end forming a neck 20 which is covered by the cap 16. The end piece 14 is fitted on the neck 20.

The body 12 furthermore comprises a transverse membrane 22 for hermetically sealing the neck. The membrane is set back from the outlet orifice of the neck.

Figure 2:
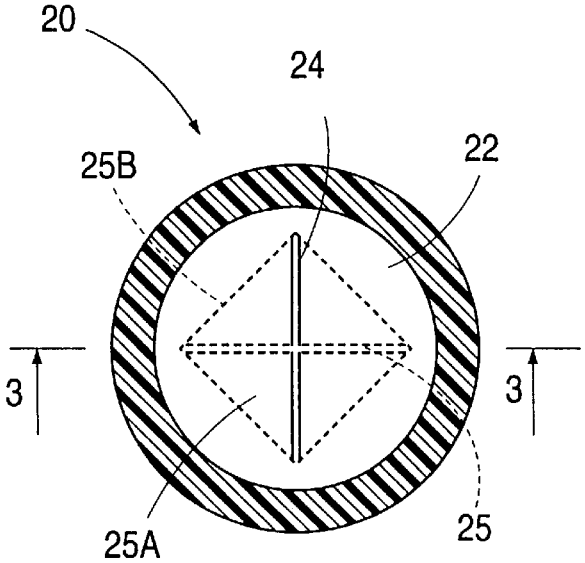
FIG. 2 is a schematic view in transverse section and on a larger scale of the neck of the bottle shown in FIG. 1.
Figure 3:
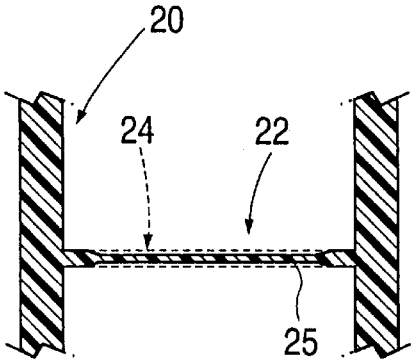
FIG. 3 is a sectional view taken on section line 3—3 of FIG. 2.

Referring to FIGS. 2 and 3 in which some details have been exaggerated for a better understanding of the present invention. The membrane 22 is relatively thick over most of its surface and has a region 24 of lower mechanical strength which weakens the membrane to make it tearable.

The weakened region 24 has the shape of a star with four points 25, uniformly distributed in the membrane 22 to form a cross. These points are produced by making the corresponding regions of the membrane 22 much thinner.

The points 25 of the weakening star in pairs delimit in the membrane 22 such that it has displaceable flaps such as 25A with a width that increases radially towards the periphery of the membrane.

Thus the membrane has four triangular flaps.

It also has four regions of articulation, such as 25B, situated close to the periphery of the membrane 22 and each one corresponding to a region where one of the flaps 25A is articulated. The articulation regions, represented in dotted lines in FIG. 2, connect the radially outermost ends of two consecutive points 25 together in pairs.

Referring again to FIG. 1, the body 12 furthermore has an annular seat 26 and a coaxial shoulder 28 of a smaller diameter closer to the neck 20. The annular seat 26 is intended to receive part of the cap 16, as will be described in detail later.

The bottle 10 furthermore comprises means for piercing the membrane 22. In the embodiment depicted, the piercing means includes a member for pushing the flaps 25A. The pushing member is formed as part of the end piece 14 and is fitted into the neck 20.

Figure 4:
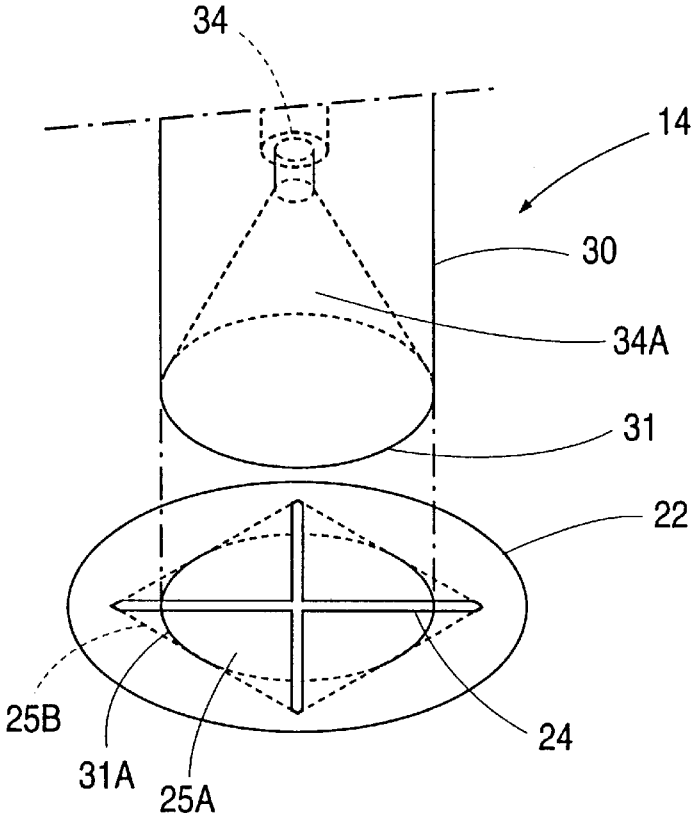
FIG. 4 is a schematic view on a larger scale of part of the end piece and of the membrane of the bottle illustrated in FIG. 1.

The end piece 14 can be moved axially in the neck 20 between a standby position and an active position for tearing or rupturing the membrane. The end piece 14 includes a stem 30 for tearing membrane 22 and the stem 30 extends into the neck 20. As shown in FIG. 4, the stem 30 includes a free-end region having a circular or annular cross-section. The free-end region defines a circular edge 31 which forms a circular region that rests against a complementary resting region 31A of the flaps 25A while the membrane 22 is torn.

The outside diameter of the stem 30 is designed so that the complementary resting region 31A of the flaps 25A intersects the points 25 at their radially outermost part. In the illustrated example, region 31A is approximately tangential to the articulation regions 25B.

The stem 30 extends downstream, that is to say upwards in FIG. 1, by a tip 32 which extends outwardly of the body 12. The end piece 14 has a duct 34 passing longitudinally through it for the flow of fluid. The duct opens upstream, i.e. downward in FIG. 1 at the free end of the stem 30, and downstream at the free end of the tip 32.

The duct 34 for the flow of fluid includes, close to its upstream end, a calibrated orifice 35 which defines the pressure drop across the duct. The orifice 35 is connected to the circular edge 31 by a region 34A, the transverse section of which increases progressively towards the orifice, giving this portion of the duct a flared shape.

At its base, the tip 32 has an annular shoulder 36 and an upstream extending skirt 38 surrounding the neck 20.

Furthermore, the bottle 10 has means of positioning the tearing stem 30 of the end piece 14 in the neck 20 in at least two relative axial positions.

In the illustrated embodiment, the means includes successive means of snap-fastening which are formed of a ring of upwardly inclined catches 40 projecting from an internal face of the skirt 38, and of two axially offset collars 42 and 44 formed on an external surface of the neck 20. Each of the collars delimits an upper snap-fastening ramp for the catches 40 and two respective grooves 45 and 46.

The shoulder 36 further comprises a set of slots 47, which are provided to facilitate mold-release of the catches 40.

As an alternative, it would be possible to provide the ring of catches on the external surface of the neck and the collars on the internal surface of the skirt. Two rows of catches are also possible, especially when combined with a single snap-fastening collar.

The bottle 10 also includes a member for manipulating the end piece 14.

The member is a cap 16 which goes over the neck 20. The cap 16 has frangible means for tamperproofing the bottle and keeping the end piece 14 in the standby-position. The means are formed of a removable tamperproofing ring 48 formed integrally with the free edge of the cap 16. The connection between the cap 16 and the tamperproofing ring 48 is provided by at least one region 49 which is thinner and thus is tearable so that the ring can be removed.

The ring 48 comprises an internal annular lip 50 which interacts with a snap-fastening collar 52 formed on the external face of the neck 20. The lip 50 defines a groove 53 below it.

Furthermore, the cap 16 has a second annular lip 54 which is similar to the lip 50 of the ring 48. The lip 54 interacts with the same groove 53 of the neck 20. Also close to its upper closed-end region, the cap 16 has a series of radial ribs 56, which form resting surfaces that are intended to interact with the shoulder 36 of the end piece 14, and a central pip or projection 58 formed on the closed end of the cap. The central projection 58 seals the downstream orifice of the duct 34 through the end piece 14.

During production of the bottle 10, the very first step is the production, by injection of a plastic, of the body 12 as a single piece. The body 12 is formed with open rear end 18 and neck 20 is sealed by the membrane 22 which is weakened by the star 24. The membrane 22 is formed integrally with the neck 20. The end piece 14 and the cap 16 are produced separately by injection molding using a plastic material.

The end piece 14 is then fitted into the neck 20 in such a way that the row of catches 40 snap-fastens into the upper notch 45.

The cap 16 is then fitted forcibly, in the hot state, onto the neck 20 far enough for the annular lip 50 of the ring 48 to snap-fasten into the groove 53. The cap 16 is immobilized with respect to the body 12. The pre-assembled bottle 10 is then ready to be filled.

Figure 5:
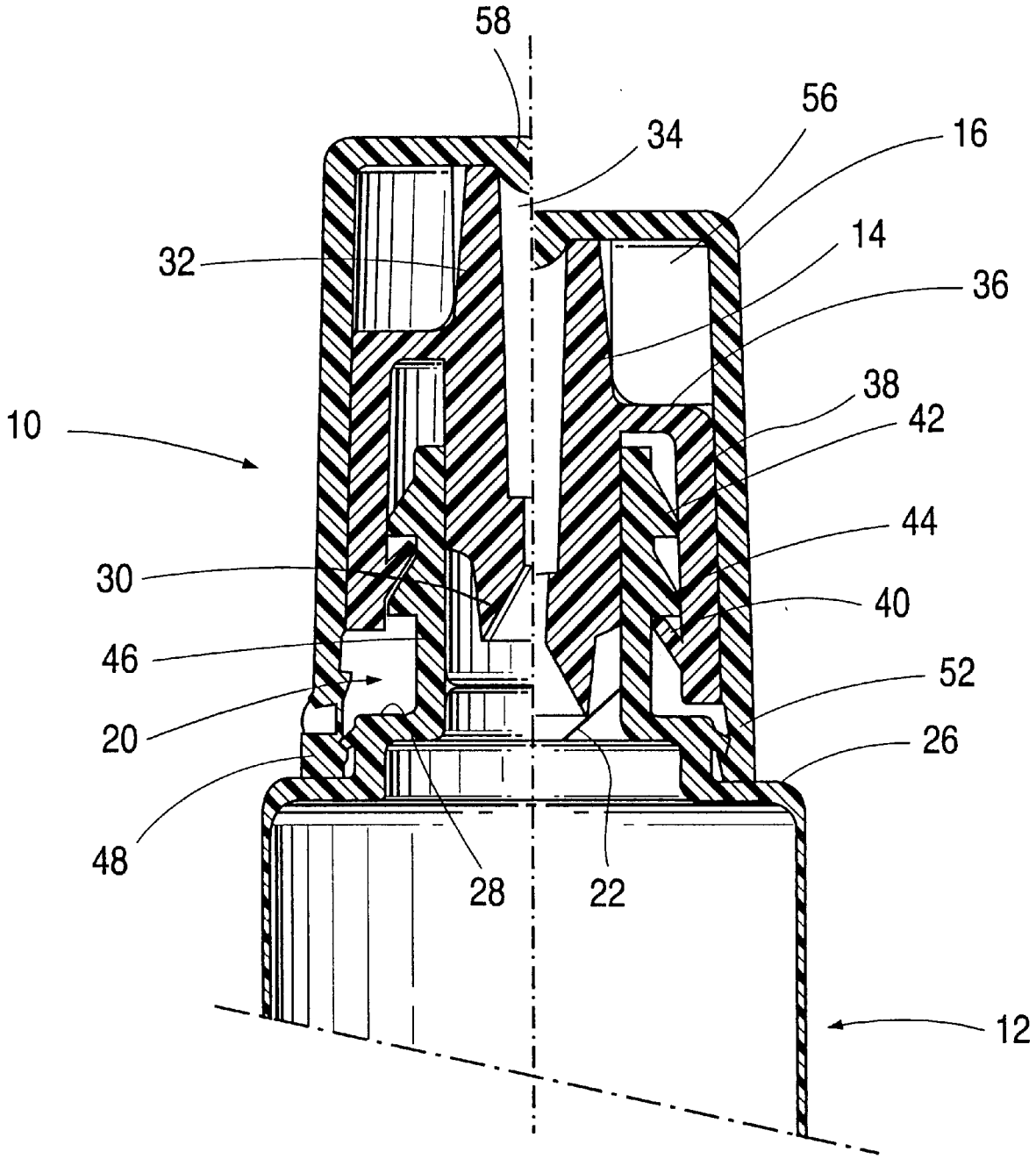
FIG. 5 is a longitudinal cross sectional view of the bottle of FIG. 1 illustrating the tearing of the membrane.

To carry out the filling process, the bottle is inverted and the hollow body 12 is filled via its open rear end 18. The bottom of the bottle 10 is sealed by pinching the walls of rear end 18 together and welding it. The bottle is thus in the condition shown in the left-hand half of FIG. 5, in which the end piece 14 is situated in the standby position and the cap is locked onto the neck 20.

It should be noted that in this position, the bottle is sealed and the product contained in the hollow body is perfectly protected from any contamination. The pre-assembled bottle can be made sterile so that the risk of contamination during filling is minimized.

The bottle is used in the following way.

To remove the cap 16, the user first removes the tamperproofing ring 48. The user then presses on the cap to move it onto the space previously occupied by the ring 48. The cap moves far enough for annular lip 54 to snap-fasten into the groove 53, and for the end edge of the cap 16 to press against the seat 26 of the body 12. The end edge of the end 14 piece thus opposes the shoulder 28.

During this movement, the radial ribs 56 of the cap come to rest against the shoulder 36 of the end piece 14. This causes the latter to move from the standby position in which the free end of the tearing stem 30 is situated downstream of, and therefore above, the membrane, into the active position for tearing the membrane 22, as shown in the right-hand half of FIG. 5. In this position, the row of catches 40 snap-fastens into the second notch 46 of the neck 20, and the stem 30 finishes upstream of (below) the periphery of the membrane.

The membrane lies in the path of the end of the stem 30. Thus, as it moves, the stem causes the points 25 of the membrane 22 to rupture as the edge 31 rests on a region of the flap which is next to the articulation regions 25B. The flaps 25A are caused to fold back about their articulation region 25B and the membrane 22 is therefore caused to open. From this moment on, the inside of the body 12 is in communication with the upstream orifice of the fluid flow duct 34.

The configuration of the membrane and of the stem 30 makes it possible to limit the travel of the end piece 14 needed for reliably tearing the membrane.

The body 12 of the bottle 10 has a structure which is radially deformable to make it easier to dispense the product. The configuration of the fluid flow duct 34 is specially designed to allow the product to be dispensed one drop at a time.

It should be noted that so long as the cap 16 is over the neck 20, the central pip or projection 58 seals the downstream orifice of the fluid flow duct 34 in order to prevent any leakage of fluid contained in the body 12, and to prevent any contamination of the liquid when the membrane 22 has been torn.

As an alternative, the base of the cap 16 may be shaped in such a way as to screw onto a screw thread provided on the external surface of the body 12. The membrane would then be pierced by taking hold of the cap and twisting it.

The invention is not restricted to the embodiments described.

Thus the membrane may just as easily have a thinned region of lower mechanical strength which has different geometric shapes, for example a circular shape with a diameter slightly larger than that of the edge 31.

It is also the case that the membrane may just as easily be situated at any point along the end edge of the neck.

I claim:

1. A bottle body formed as a single piece of injected plastic and having an open rear end to allow said bottle body to be filled with a fluid product, and a narrowed front end forming a neck, said bottle body further comprising:

an integrally formed tearable transverse membrane for sealing a front end region of said bottle body;

means for piercing said membrane, said piercing means being axially movable in said neck between a standby position and an active position for piercing said membrane; and a member for manipulating said piercing means, said member being secured to the rest of said bottle body by frangible means for tamperproofing and maintaining said piercing means in the standby position, said manipulating member comprising a cap which is disposed over said neck and is axially movable with respect to said neck following removal of said frangible tamperproofing means, said cap having a surface for resting against an opposing surface of said piercing means, wherein said piercing means and said neck have mutually cooperating projections arranged to define said standby position and said active position of said piercing means, said projections being adapted to prevent return of said piercing means from said active position to said standby position.

2. A bottle body as claimed in claim 1, wherein said piercing means comprises:

an end piece mounted on said neck;

a longitudinally extending duct formed in said end piece for permitting fluid flow therethrough; and a stem extending into said neck for tearing said membrane.

3. A bottle body as claimed in claim 1, wherein said membrane has a thinned region which has less mechanical strength in order to facilitate tearing of said membrane.

4. A bottle body as claimed in claim 3, wherein said piercing means comprises:

an end piece mounted on said neck;

a longitudinally extending duct formed in said end piece for permitting fluid flow therethrough; and a stem extending into said neck for tearing said membrane.

5. A bottle body as claimed in claim 3, wherein said thinned region forms a cross in said membrane.

6. A bottle body as claimed in claim 5, wherein said piercing means comprises:

an end piece mounted on said neck;

a longitudinally extending duct formed in said end piece for permitting fluid flow therethrough; and a stem extending into said neck for tearing said membrane.

7. A bottle body as claimed in claim 6, further comprising:

a first collar formed on an exterior surface of said bottle body;

a first lip formed on an interior surface of said tamperproofing means, wherein said first lip interacts with said first collar; and a second lip formed on an interior peripheral surface of said cap.

8. A bottle body as claimed in claim 6, wherein said mutually cooperating projections are capable of positioning said end piece in at least two axial positions relative to said bottle body.

9. A bottle body as claimed in claim 7, wherein said mutually cooperating projections are capable of positioning said end piece in at least two axial positions relative to said bottle body.

10. A bottle body as claimed in claim 9, wherein said end piece includes an axially extending skirt surrounding said neck, and said mutually cooperating projections comprise successive snap fastening means which includes:

at least one collar disposed on one of an exterior surface of said neck and an interior surface of said axially extending skirt; and at least one catch disposed on the other of the exterior surface of said neck and the interior surface of said axially extending skirt.

11. A pre-assembled bottle comprising:

a bottle body formed of injected plastic, said bottle body having an open rear end, a narrowed front end defining a neck, and a tearable membrane extending across a passage formed by said neck so as to form a seal at a front end region of said bottle body, wherein said tearable membrane is set back from the front end of said bottle body;

an end piece connected to the neck such that said end piece is axially movable in said neck between a standby position and an active position to pierce said membrane;

a duct extending longitudinally through said end piece for allowing fluid flow therethrough; and a cap disposed over said neck and including tamperproofing means for holding said end piece in the standby position, wherein said end piece and said neck have mutually cooperating projections arranged to define said standby position and said active position of said end piece, said projections being adapted to prevent return of said end piece from said active position to said standby position.

12. A method of producing a bottle having a tearable membrane, said method comprising:

injecting plastic to form a bottle body sealed with the tearable membrane, an end piece, and a cap, wherein said bottle body includes an open end and an opposite end defining a neck, and said end piece defines a longitudinally extending duct for permitting fluid flow therethrough and wherein said end piece and said neck have mutually cooperating projections;

assembling said end piece on said neck such that said end piece is axially movable in said neck so as to be guided between a standby position and an active position for piercing said tearable membrane which is set back from a front end of said neck, said projections being arranged to define said standby position and said active position of the end piece, said projections being adapted to prevent return of said end piece from said active position to said standby position;

covering said neck with said cap such that said cap is connected to said bottle body by frangible means for tamperproofing and keeping said end piece in the standby position;

filling said bottle body with a fluid product via said open end; and sealing said open end of said bottle body by pinching and welding edge portions of said open end together.

* * * * *